United States Patent [19]

Lee

[11] Patent Number: 5,003,134

[45] Date of Patent: Mar. 26, 1991

[54] PRESS TYPE ELECTRIC SWITCH

[76] Inventor: Jen J. Lee, No. 7, Alley 14, Lane 101, Shyue Fu Rd., San Ho Tsun, Ta Ya Hsiang, Taichung Hsien, Taiwan

[21] Appl. No.: 567,778

[22] Filed: Aug. 15, 1990

[51] Int. Cl.[5] ..... H01H 9/20

[52] U.S. Cl. ..... 200/5 E; 200/5 EA

[58] Field of Search ..... 200/5 E, 5 EA, 5 EB, 200/18, 50 C, 520, 533, 341, 345

[56] References Cited

U.S. PATENT DOCUMENTS

| | | | |
|---|---|---|---|
| 2,652,470 | 9/1953 | Batcheller | 200/5 EB X |
| 2,968,704 | 1/1961 | Woodward et al. | 200/18 |
| 4,743,714 | 5/1988 | Chien | 200/5 E |

*Primary Examiner*—J. R. Scott

*Attorney, Agent, or Firm*—Watson, Cole, Grindle & Watson

[57] ABSTRACT

A switch includes two casings engaged together. Four shafts are extendible through the upper casing. Four pairs of ribs are formed in the lower casing. A contact arm is received in the lower casing. Three conductors are provided in the lower casing. A retaining plate and a control plate are slidably provided between the protrusions and the ribs. Each conductor is caused to contact the contact arm when the shaft is depressed downward. Two or more shafts are prevented from being fully depressed by the control plate. A projection of each shaft slides between the ribs so that the shaft will not be distorted when two or more shafts are depressed simultaneously.

1 Claim, 5 Drawing Sheets

PRESS TYPE ELECTRIC SWITCH

BACKGROUND OF THE INVENTION

The present invention relates to a switch, and more particularly to a press type electric switch.

There are kinds of electric switches used today. One of them is press type electric switch which is widely used in tape recorders, electric fans or other electric facilities for changing the functions of the recorders or for changing the rotating speed of the fans of the electric fans. The press type switch generally comprises three or more buttons which can be pressed individually. The elements within the switch may be deformed or a short circuit may be generated when two of the buttons are pressed simultaneously by children who do not know this is dangerous. As far as the applicant is aware, there is no safety device provided to prevent deformation or distortion of the elements within the switch.

The present invention has arisen to mitigate and/or obviate the afore-described disadvantages of the conventional press type electric switch.

SUMMARY OF THE INVENTION

The primary objective of the present invention is to provide a press type electric switch which has a safety device provided to prevent deformation of the elements within the switch so that the working life of the switch is increased.

In accordance with one aspect of the invention, there is provided a press type electric switch which includes a lower casing and an upper casing engagable with each other. Four shafts are extendible through the upper casing. Four pair of ribs are formed in the lower casing. A contact arm is received in the lower casing. Three conductors are provided in the lower casing. A retaining plate and a control plate are slidably provided between the protrusions and the ribs. Each conductor is caused to contact the contact arm when a shaft is depressed downward. Two or more shafts are prevented from being fully depressed by the control plate. A projection of each shaft slides between the ribs so that the shaft will not be distorted when two or more shafts are depressed simultaneously.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
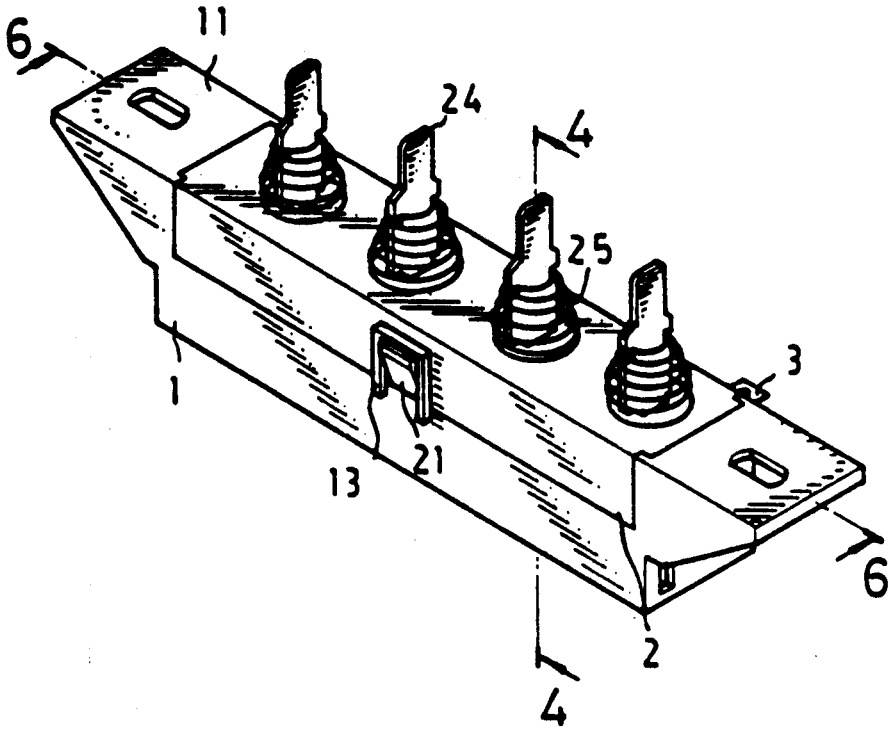
FIG. 1 is a perspective view of a press type electric switch in accordance with the present invention.
Figure 2:
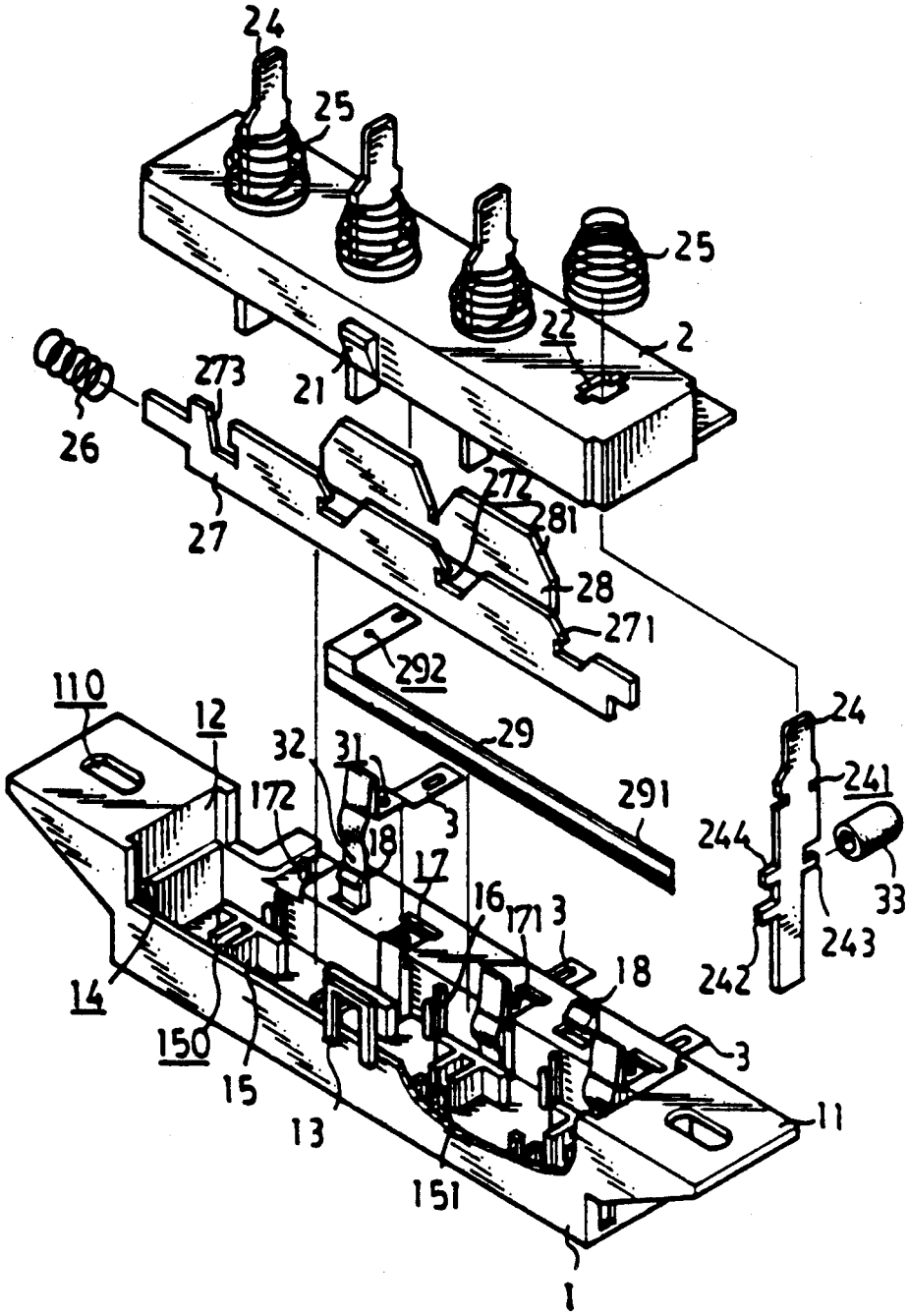
FIG. 2 is an exploded view of the switch.
Figure 3:
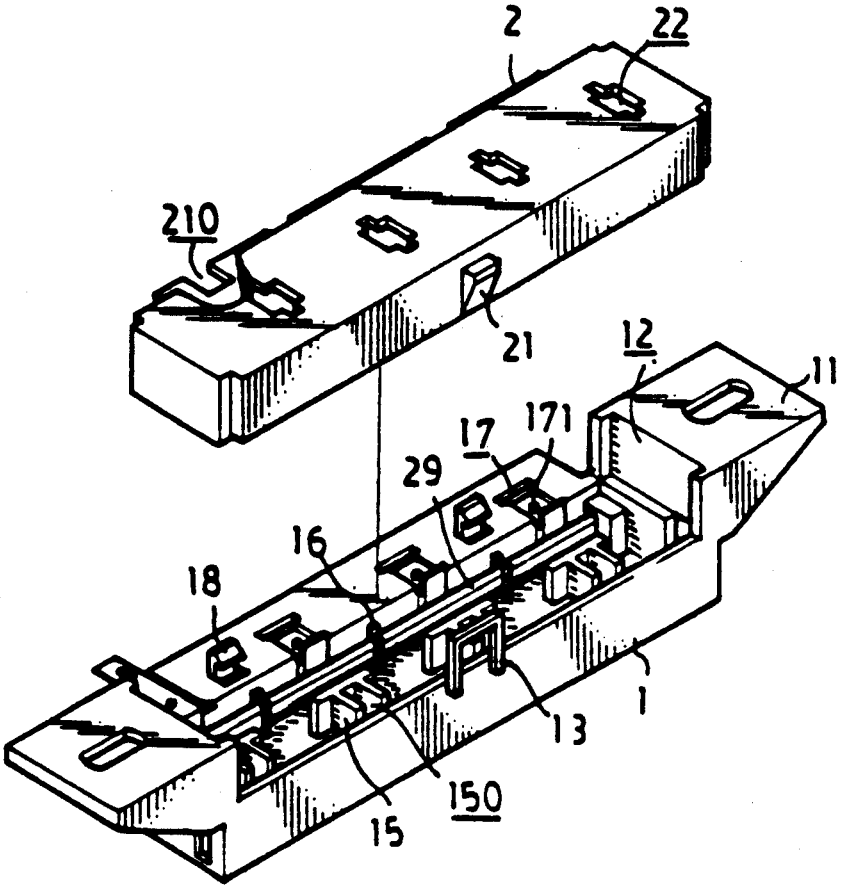
FIG. 3 is a partial exploded view of the switch.

Referring to the drawings and initially to FIGS. 1, 2 and 3, the press type electric switch in accordance with the present invention comprises generally a lower casing 1 and an upper casing 2 coupled together by retaining clamp 21 and retaining ring 13, and hooks 18 and notches 210 (FIG. 3). Four shafts 24 are provided on the upper casing 2 and vertically extended through the upper surface of the upper casing 2.

Two lugs 11 are provided on both ends of the lower casing 1 and an oblong hole 110 is formed in each lug 11 so that the lower casing 1 can be attached to a control board of an electric fan or a recorder. An open space 12 is formed in an upper end of said lower casing 1 for receiving said upper casing 2. An opening 14 is formed in one end of the lower part of the lower casing 1. Four protrusions 15 are provided in the lower casing 1 and are spaced apart. Each protrusion 15 has a channel 150 vertically formed therein for slidably receiving the shafts 24. A pair of ribs 151 are intergrally formed in the inner and front side of the lower casing 1 and provided in front of each protrusion 15. Three pairs of pins 16 are formed in the inner and rear side of the lower casing 1. Three holes 17 and three locating pins 171 and a locating pin 172 are formed in the rear side of the lower casing 1 and are aligned with the respective protrusions 15.

Figure 4:
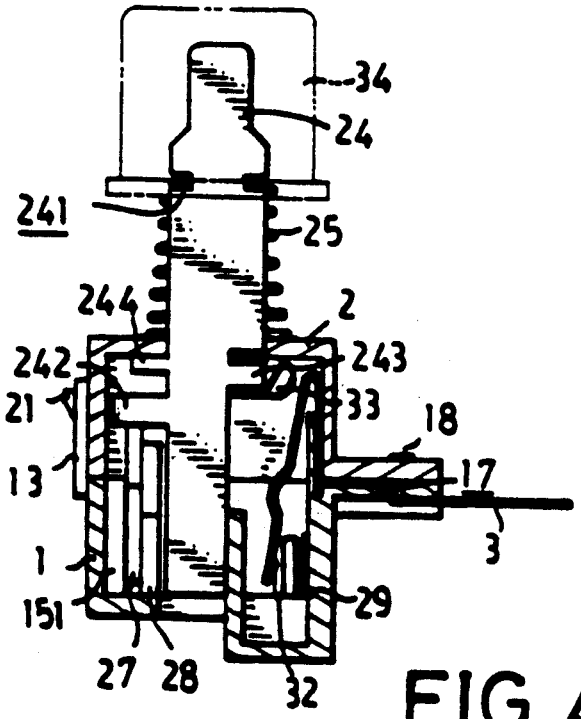
FIG. 4 is a cross sectional view of the switch taken along lines 4—4 of FIG. 1.

A rear end of a conductor 3 passes through each hole 17 and extends rearward. Each conductor 3 has a hole 31 engaged with the locating pin 171. A spring-like conducting metal structure is formed on a front end of each conductor 3 which has a contact 32 provided to a front and lower end thereof (FIG. 4). A locating pin 172 is provided on the rear side of the lower casing 1. A contact arm 29 which is L-shaped has a long leg 291 received between the three pairs of pins 16. A hole 292 which is formed in the short leg of the contact arm 29 is engaged with the locating pin 172.

A retaining plate 27 and a control plate 28 are slidably provided between the protrusions 15 and the ribs 151. One end of the retaining plate 27 extends through the opening 14 and is biased by a spring 26. A tapered surface 273 and three pairs of tapered surfaces 271 and notches 272 are formed in the retaining plate 27 and are spaced apart. Four tilted surfaces 281 are formed in an upper side of the control plate 28.

Four holes 22 are formed in the upper surface of the upper casing 2 for receiving the respective shaft 24. Each shaft 24 has a notch 241 formed in an upper end thereof. An upper end of a spring 25 is engaged in the notch 241 and the spring is biased against the upper surface of the upper casing 2 so that each shaft 24 is biased upward by the spring 25. A bulge 243 is formed on a middle portion of the shaft 24 for supporting a sleeve 33. A projection 242 and a stop 244 are formed on each shaft 24 opposite to the bulge 243. A button 34 is disposed on the upper end of each shaft 24, as shown in dotted lines in FIG. 4. The lower end of each shaft 24 is slidable in the channel 150 of a respective protrusion 15. The stop 244 limits an upward movement of the shaft 24.

Figure 5:
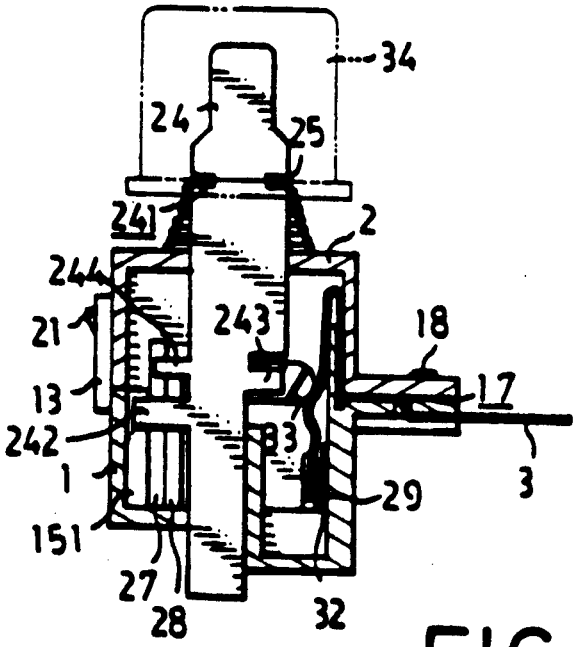
FIG. 5 is a cross sectional view similar to FIG. 4, illustrating a working position of the switch.

Referring next to FIGS. 4 and 5, and initially to FIG. 4, illustrated is an uppermost position of the shaft 24 when the stop 244 bears against the inner surface of the upper casing 2. At this position, the sleeve 33 is not contacted with the spring-like conducting metal structure which is formed on the front end of each conductor 3 so that the contact 32 of the conductor 3 is not contacted with the contact arm 29. As shown in FIG. 5, when the button 34 is depressed downward, the sleeve 33 is caused to move downward to press the conductor 3 so that the contact 32 of the conductor 3 is caused to contact the contact arm 29. The projections 242 of the shafts 24 are long enough so that the free ends of the projections 242 are guided to slide along the respective pairs of ribs 151.

Figure 6:
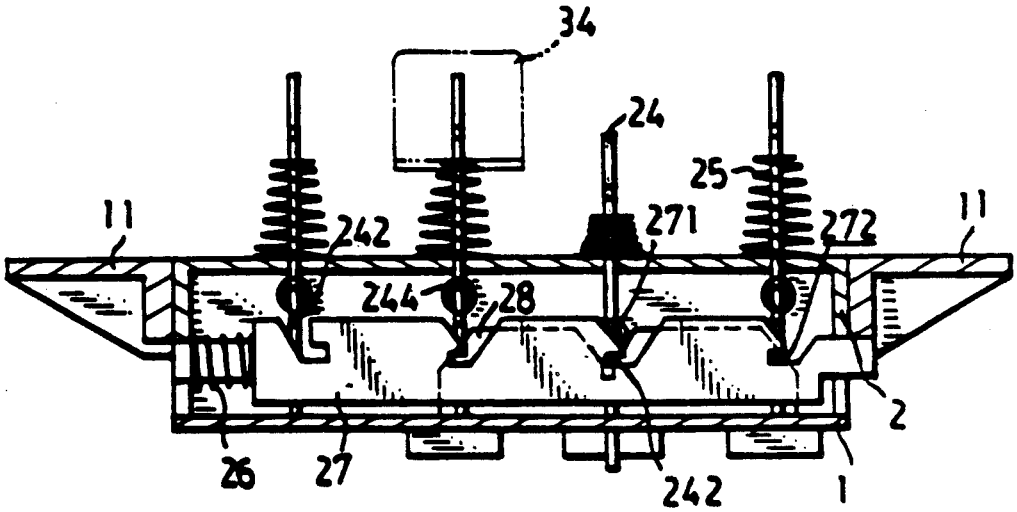
FIGS. 6 and 7 are cross sectional views of the switch taken along lines 6—6 of FIG. 1.
Figure 7:
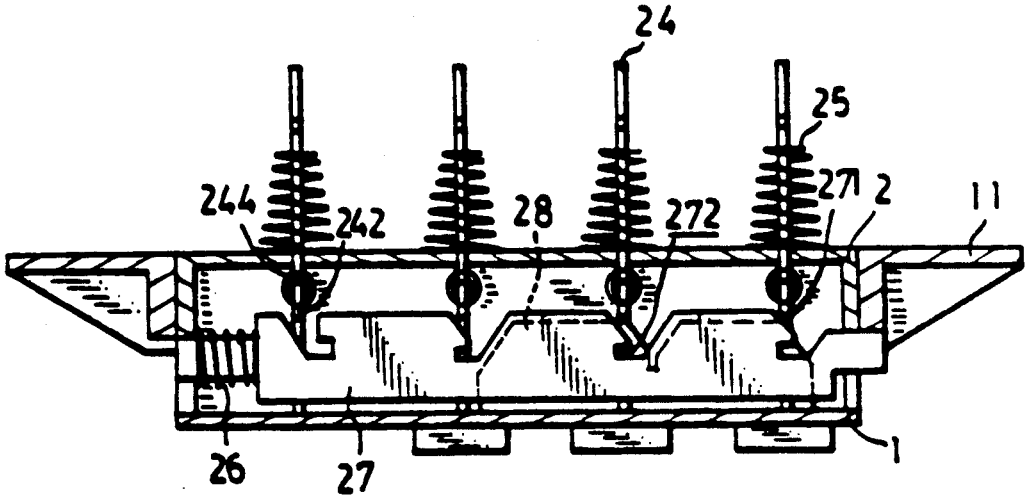

Referring next to FIGS. 6 and 7, and initially to FIG. 6, when one of the shaft 24 is depressed downward, the retaining plate 27 is caused to move leftward by a sliding engagement between the projection 242 and the tapered surface 271 until the projection 242 is retained in the notch 272 of the retaining plate 27. When another shaft 24 is depressed downward, the retaining plate 27 is caused to move leftward again. The previously depressed shaft 24 is caused to be separated from the notch 272 and is biased to move upward by the spring 25 before the projection 242 of the lately depressed shaft 24 is engaged within the notch 272. The tilted surfaces 281 of the control plate 28 are arranged such that only one shaft 24 can be fully depressed downward and the projections 242 of the other shafts 24 are prohibited from engaging within the notches 272 of the retaining plate 27. When the leftmost shaft 24 is depressed downward, either depressed shaft 24 will be biased upward, as shown in FIG. 7. The leftmost shaft 24 will not be retained in the downward position because no notch is formed in the retaining plate 27 for retaining the leftmost shaft 24.

Referring again to FIGS. 4 to 7, when two or more of the shafts 24 are simultaneously depressed downward inadvertently or simultaneously depressed downward by children, the control plate 28 prevents the shafts 24 from moving to the lowermost positions simultaneously. The free ends of the projections 242 are guided to slide along the ribs 151. On the other hand, the ribs 151 are provided to slidably retain the free ends of the projections 242 so that the lower end portions of the shafts 24 will not be distorted or deformed when two or more shafts 24 are depressed downward simultaneously.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A press type electric switch comprising generally a lower casing and an upper casing engagable with each other, said lower casing which is substantially parallelepiped having two lugs provided on both ends thereof, an open space being formed in an upper portion of said lower casing for receiving said upper casing, at least three protrusions being provided in said lower casing and being spaced apart, each protrusion having a channel vertically formed therein for slidably receiving a shaft, a pair of ribs being intergrally formed in an inner and front surface of said lower casing and provided in front of each said protrusion, at least two pairs of pins being formed in an inner and rear surface of said lower casing; a contact arm which is L-shaped having a long leg received between said pairs of pins and having a short leg extending rearward and outward through said lower casing, said short leg being aligned with one of said protrusions; at least two conductors being aligned with the other protrusions, a rear end of each said conductor extending rearward and outward through said lower casing, a spring-like conducting metal structure being formed on a front end of each said conductor; a retaining plate and a control plate being slidably provided between said protrusions and said ribs, one end of said retaining plate being biased by a resilient element, a first tapered surface and at least two pairs of second tapered surfaces and notches being formed in said retaining plate and being spaced apart, four tilted surfaces being formed in an upper side of said control plate; a shaft having a lower end slidable in each said channel of said protrusions and having an upper end extending upward beyond said upper casing, a spring being biased between each said upper end of said shaft and an upper surface of said upper casing so that said shafts are biased upward by said springs; a bulge and a projection being oppositely formed on a middle portion of each said shaft; said spring-like conducting metal structure of each said conductor being caused to contact said contact arm by said bulge when a respective shaft is depressed downward; said projection being retained in said notch when a respective shaft is depressed downward, and being released when another shaft is depressed downward; said tilted surfaces of said control plate being arranged such that two or more shafts are prevented from moving to the lowermost positions simultaneously; and a free end of each said projection being guided to slide between a respective pairs of ribs and protected by said ribs so that said shaft will not be distorted when two or more shafts are depressed downward simultaneously.

* * * * *